US009042801B2

(12) United States Patent
Mogi

(10) Patent No.: US 9,042,801 B2
(45) Date of Patent: May 26, 2015

(54) IMAGE HEATING APPARATUS

(71) Applicant: CANON KABUSHIKI KAISHA, Tokyo (JP)

(72) Inventor: Keisuke Mogi, Noda (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/973,336

(22) Filed: Aug. 22, 2013

(65) Prior Publication Data

US 2014/0064786 A1 Mar. 6, 2014

(30) Foreign Application Priority Data

Sep. 6, 2012 (JP) ..... 2012-195668

(51) Int. Cl.
*G03G 15/20* (2006.01)
*G03G 21/16* (2006.01)

(52) U.S. Cl.
CPC ..... *G03G 21/1685* (2013.01); *G03G 15/2053* (2013.01); *G03G 2215/2035* (2013.01)

(58) Field of Classification Search
CPC ..... G03G 15/2053
USPC ..... 399/329, 328
See application file for complete search history.

(56) References Cited

U.S. PATENT DOCUMENTS

| | | | | |
|---|---|---|---|---|
| 8,554,097 | B2 | 10/2013 | Hara | |
| 2007/0095820 | A1* | 5/2007 | Kinouchi et al. | 219/619 |
| 2008/0302785 | A1* | 12/2008 | Kinouchi et al. | 219/619 |
| 2010/0215414 | A1* | 8/2010 | Uchiyama et al. | 399/329 |
| 2010/0247184 | A1* | 9/2010 | Iwai | 399/329 |
| 2014/0029994 | A1* | 1/2014 | Sugaya | 399/329 |

FOREIGN PATENT DOCUMENTS

JP 2003-7446 A 1/2003

OTHER PUBLICATIONS

U.S. Appl. No. 13/946,336, filed Jul. 19, 2013, Masahiro Nawa et al.

* cited by examiner

*Primary Examiner* — Rodney Bonnette
(74) *Attorney, Agent, or Firm* — Fitzpatrick, Cella, Harper & Scinto

(57) ABSTRACT

An image heating apparatus includes a rotatable heating member; an exciting coil; a magnetic core including a first engaging portion in the neighborhood of an end thereof and a second engaging portion in the neighborhood of another end thereof; a holder including a first recess into which the first engaging portion is inserted and a second recess into which the second engaging portion is inserted; and an elastic member fixed on the holder so as to be located between the magnetic core and the holder. The elastic member urges the first engaging portion, inserted into the first recess, in a direction perpendicular to an inserting direction so that a position of the second engaging portion is determined by the second recess.

26 Claims, 9 Drawing Sheets

IMAGE HEATING APPARATUS

FIELD OF THE INVENTION AND RELATED ART

The present invention relates to an image heating apparatus usable in an image forming apparatus such as a copying machine, a printer, a facsimile or a multi-function machine having a plurality of functions of these machines.

The image forming apparatus includes a fixing device as an image heating apparatus for fixing an unfixed image formed on a recording material by an image forming portion. As such a fixing device, a constitution of an IH (electromagnetic induction heating) type has been proposed for meeting needs of energy saving and speed-up of the image forming apparatus.

The fixing device of the IH type generates eddy current in a heating belt as a rotatable heating member by a magnetic field generated by an exciting coil as a means for heating the heating belt, so that heat is generated by Joule heat. In the case of this constitution, a heat generating source can be placed in close proximity to a toner and therefore compared with a conventional type using a halogen lamp, there is an advantage such that a warm-up time can be shortened. Further, there is also an advantage such that a heat conduction path from the heat generating source to the toner is short and simple and therefore heat efficiency is high.

In such a fixing device of the IH type, in order to concentrate magnetic flux generated from the exciting coil at the heating belt, a plurality of magnetic cores are arranged along a longitudinal direction of the heating belt.

For this reason, the plurality of magnetic cores are required to be fixed at a predetermined position, but as a constitution for fixing the magnetic cores, a constitution in which the magnetic cores are adhesively fixed to a core holder by a heat-resistant adhesive has been proposed (Japanese Laid-Open Patent Application (JP-A) 2003-7446).

However, in the case of the magnetic core fixing method (constitution) described in JP-A 2003-7446, there is a fear as described below.

That is, in the case of the fixing method in which the magnetic core is fixed by the adhesive, many steps such that the adhesive is applied to the magnetic core and then is dried are needed. Therefore, there are fears that time required for manufacturing the fixing device becomes long and that a cost required for manufacturing the fixing device becomes high.

SUMMARY OF THE INVENTION

A principal object of the present invention is to provide an image heating apparatus capable of permitting easy mounting of a magnetic core on a holder.

According to an aspect of the present invention, there is provided an image heating apparatus comprising: a rotatable heating member configured to heat a toner image on a sheet; an exciting coil configured to cause the rotatable heating member to generate heat by electromagnetic induction heating; a magnetic core configured to guide magnetic flux, generated by the exciting coil, to the rotatable heating member, wherein the magnetic core includes a first engaging portion in the neighborhood of an end thereof and a second engaging portion in the neighborhood of another end thereof; a holder holding the magnetic core and including a first recess into which the first engaging portion is inserted and a second recess into which the second engaging portion is inserted; and an elastic member fixed on the holder so as to be located between the magnetic core and the holder, wherein the elastic member urges the first engaging portion, inserted into the first recess, in a direction perpendicular to an inserting direction so that a position of the second engaging portion is determined by the second recess.

According to another aspect of the present invention, there is provided an image heating apparatus comprising: a rotatable heating member configured to heat a toner image on a sheet; an exciting coil configured to cause the rotatable heating member to generate heat by electromagnetic induction heating; first and second magnetic cores each configured to guide magnetic flux, generated by the exciting coil, to the rotatable heating member, wherein the first and second magnetic core and arranged along a sheet conveyance direction, wherein the first magnetic core includes a first engaging portion in the neighborhood of an end thereof and a second engaging portion in the neighborhood of another end thereof, and wherein the second magnetic core includes a third engaging portion in the neighborhood an end thereof and a fourth engaging portion in the neighborhood of another end thereof; a holder holding the first and second magnetic cores and including a first recess into which the first engaging portion is inserted, a second engaging portion is inserted, a third recess into which the third engaging portion is inserted; and a fourth recess into which the fourth engaging portion is inserted; and an elastic member fixed on the holder so as to be located between the holder and the first and second magnetic cores, wherein the elastic member urges the first engaging portion inserted into the first recess and the third engaging portion inserted into the third recess in a direction perpendicular to an inserting direction so that positions of the second engaging portion and the fourth engaging portion are determined by the second recess and the fourth recess, respectively.

According to another aspect of the present invention, there is provided an image heating apparatus comprising: a rotatable heating member configured to heat a toner image on a sheet; an exciting coil configured to cause the rotatable heating member to generate heat by electromagnetic induction heating; a magnetic core configured to guide magnetic flux, generated by the exciting coil, to the rotatable heating member, wherein the magnetic core includes an engaging portion in the neighborhood of an end portion thereof; a holder holding the magnetic core and including a recess into which the end portion of the magnetic core is inserted; and an elastic member fixed on the holder so as to be located between the magnetic core and the holder, wherein the elastic member includes a limiting portion for limiting movement of the engaging portion in a direction opposite to the inserting direction of the engaging portion into the recess.

According to a further aspect of the present invention, there is provided an image heating apparatus comprising: a rotatable heating member configured to heat a toner image on a sheet; an exciting coil configured to cause the rotatable heating member to generate heat by electromagnetic induction heating; first and second magnetic cores each configured to guide magnetic flux, generated by the exciting coil, to the rotatable heating member, wherein the first and second magnetic core and arranged along a sheet conveyance direction, wherein the first magnetic core includes a first engaging portion in the neighborhood of an end thereof, and where in the second magnetic core includes a second engaging portion in the neighborhood of an end thereof; a holder holding first and second magnetic cores and including a first recess into which the first engaging portion is inserted, and a second engaging portion is inserted; and an elastic member fixed on the holder so as to be located between the holder and the first and second magnetic cores, wherein the elastic member includes a first limiting portion for limiting movement of the first engaging portion in a direction opposite to an inserting direction of the first engaging portion into the first recess and includes a second limiting portion for limiting movement of the second engaging portion in a direction opposite to the inserting direction of the second engaging portion into the second recess.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

First Embodiment

Figure 1:
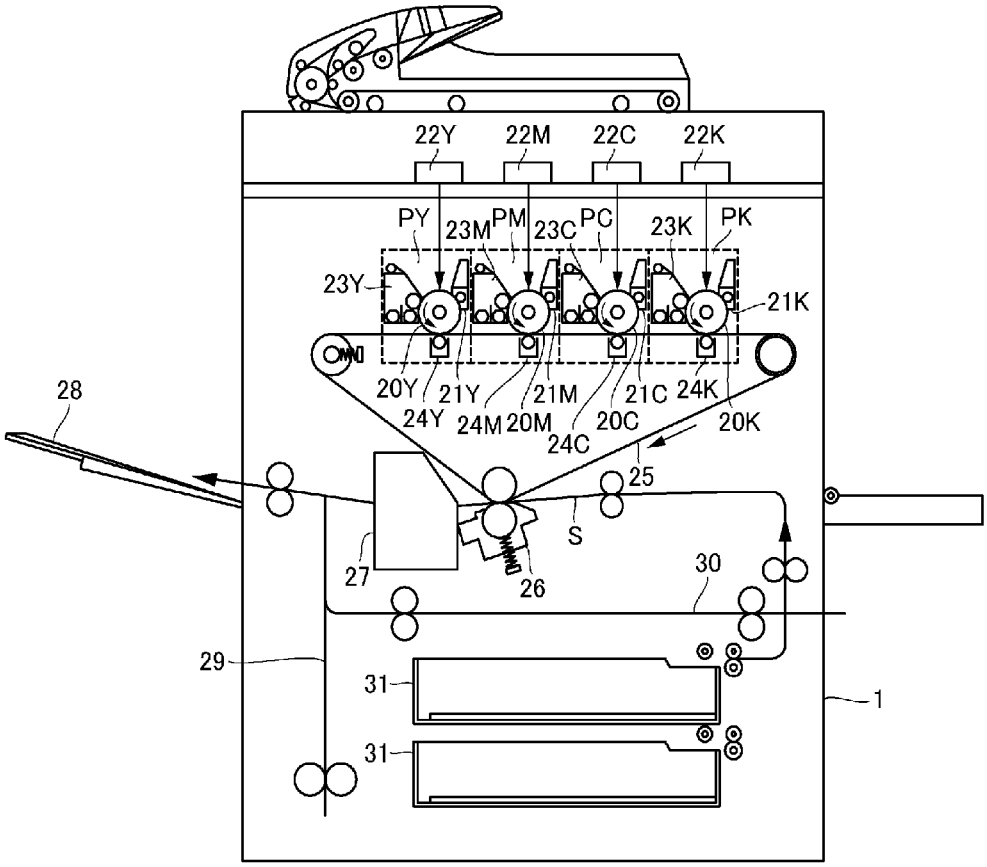
FIG. 1 is a schematic sectional view of a structure of an image forming apparatus in First Embodiment.

First Embodiment of the present invention will be described with reference to FIGS. 1 to 14. First, an image forming apparatus in this embodiment will be described with reference to FIG. 1.

[Image Forming Apparatus]

An image forming apparatus 1 includes a fixing device 27, as an image heating apparatus, in which an unfixed image transferred onto a recording material S including a sheet such as paper is fixed by applying heat and pressure to the unfixed image. Incidentally, in this embodiment, as the image forming apparatus 1, a full-color image forming apparatus of an intermediary transfer type is illustrated, but the image forming apparatus including the image heating apparatus according to the present invention is not particularly limited thereto.

The image forming apparatus 1 employs a tandem type in which image forming portions PY, PM, PC and PK for forming toner images of four colors of Y (yellow), M (magenta), C (cyan) and K (black), respectively. The image forming portions PY, PM, PC and PK are provided and arranged in a rotational direction of an intermediary transfer belt 25 as an intermediary transfer member and effects process until the toner images are formed for the respective colors in parallel.

Incidentally, constitutions of the respective image forming portions are basically the same, and therefore in the following description, suffixes Y, M, C and K showing constituent elements of the respective image forming portions are omitted and will be added only in the drawings and necessary description.

The image forming portion P includes a photosensitive drum 20 as an image bearing member on which an associated color toner images formed and carried. At a periphery of the photosensitive drum 20, a charging device 21, a developing device 23, a primary transfer device 24 and an unshown cleaner are provided. Further, at an upper portion of the image forming apparatus 1, an exposure device 22 is provided.

The photosensitive drum 20 is rotationally driven in a direction of an arrow in FIG. 1 and a surface thereof is electrically charged uniformly by the charging device 21 to a predetermined potential. Thereafter, the surface of the photosensitive drum 20 charged to the predetermined potential by the charging device 21 is exposed to light by the exposure device 22, so that an electrostatic latent image is formed on the photosensitive drum 20. The electrostatic latent image on the photosensitive drum 20 is developed with a developer by the developing device 23, so that the electrostatic latent image is visualized as the toner image.

The respective toner images each developed from the electrostatic latent image by the developing device 23 are successively primary-transferred superposely by the primary transfer device 24 onto the intermediary transfer belt 25 having an endless shape. Then, the toner images of all the colors primary-transferred onto the intermediary transfer belt 25 are collectively secondary-transferred on the recording material S by a secondary transfer device 26. Each of the surface of the photosensitive drum 20 after the primary transfer and the surface of the intermediary transfer belt 25 after the secondary transfer are cleaned by an unshown cleaner, and then is used for subsequent image formation.

The recording material S is conveyed by a conveying means such as a conveying roller from a sheet feeding cassette 31 to a secondary transfer portion constituted by the second transfer device 26 and the intermediary transfer belt 25. After the secondary transfer, the recording material (sheet) S on which unfixed toner images are carried is conveyed to a fixing device 27. Then, the unfixed toner images are melted and softened by being heated and pressed by the fixing device 27, thus being fixed on the recording material. The recording material S on which the toner images are fixed on the recording material S. The recording material S on which the toner images are fixed is discharged onto a sheet discharge tray 28. When the image is formed on a back surface of the recording material S, the recording material S is, after being reversed by a recording material reversing path 29, conveyed again to the second transfer portion via a conveying path 30 for both-side printing, so that the image is formed on the back surface of the recording material S.

As described above, a series of image forming processes of charging, exposure, development, transfer and fixing is executed, so that the image is formed on the recording material S. Incidentally, in a monochromatic image forming apparatus, only the image forming portion for black is provided. Further, the order of arrangement and the constitutions of the respective image forming portions for Y, M, C and K are not limited to those described above.

[Fixing Device]

Figure 2:
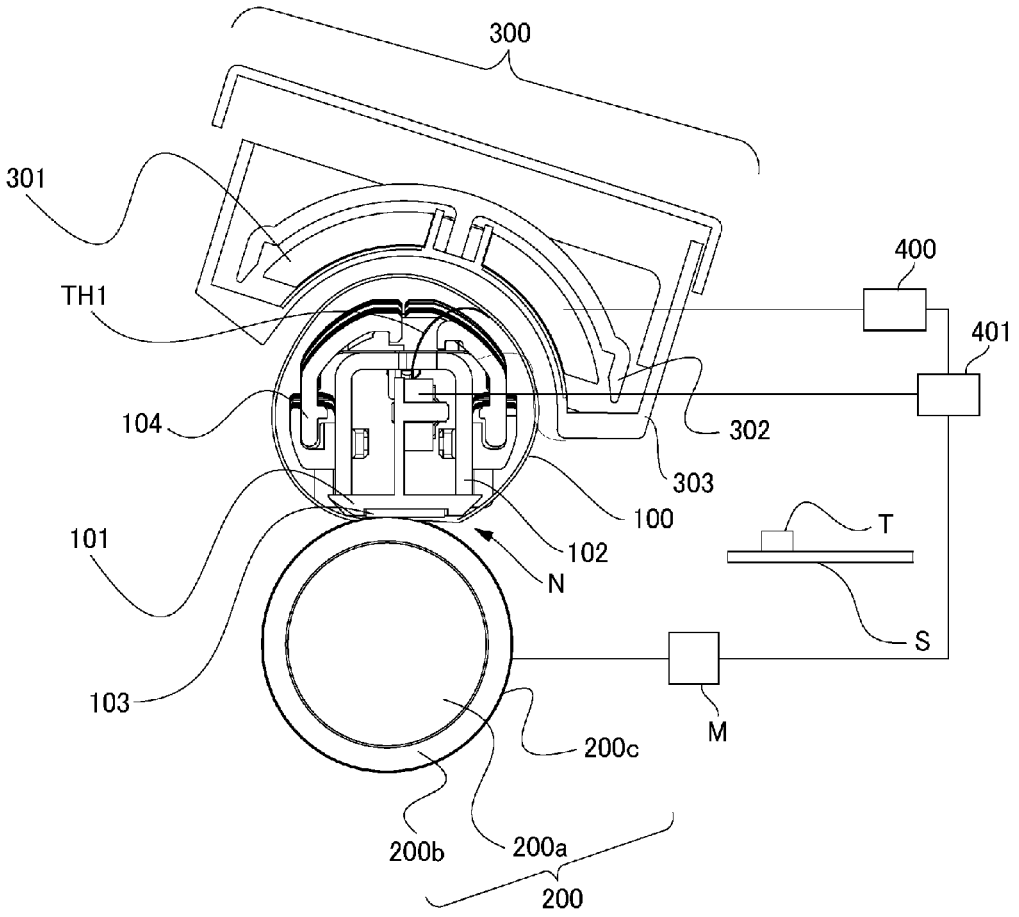
FIG. 2 is a schematic sectional view of a structure of a fixing device in First Embodiment.
Figure 3:
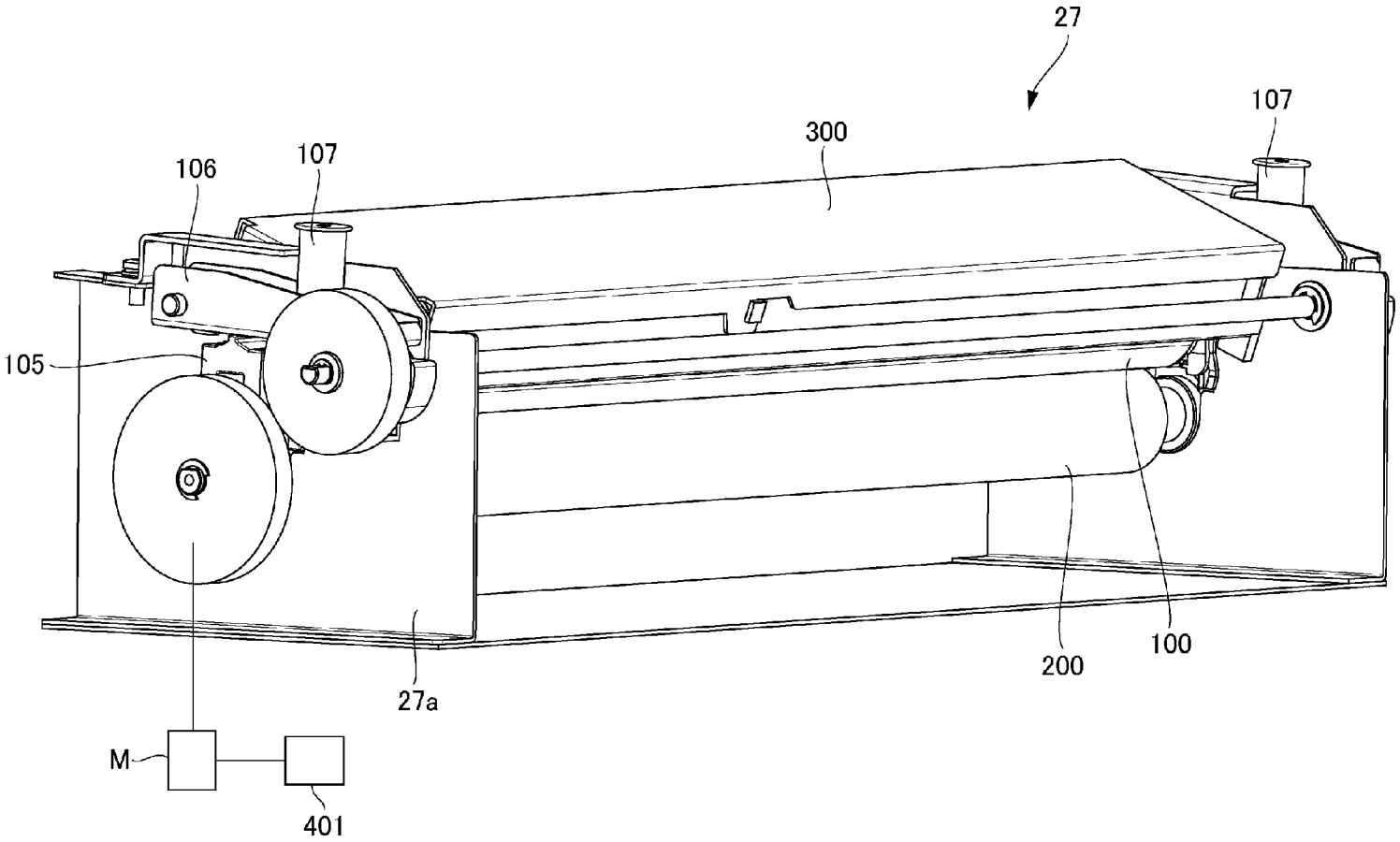
FIG. 3 is a perspective view of the fixing device in First Embodiment.

The fixing device 27 functioning as the image heating apparatus will be described with reference to FIGS. 2 to 5. The fixing device 27 includes, as shown in FIGS. 2 and 3, a heating belt 100 as a rotatable heating member, a pressing roller 200 as a rotatable pressing member for forming a nip N in contact with an outer peripheral surface of the heating belt 100, and an induction heating device 300. The heating belt 100 is an endless belt having a metal layer and generates heat by passing therethrough magnetic fluxed by the induction heating device 300, thus heating the conveyed recording material. The pressing roller 200 is, as described later, rotationally driven by a motor M as a driving means and functions as also a rotatable driving member for rotationally driving the heating belt 100.

Inside the heating belt 100, a pad member 101 and a stay 102 are provided over a rotational axis direction (longitudinal direction). The pad member 101 causes an urging force to act between the heating belt 100 and the pressing roller 200 to form the nip N. The stay 102 is formed with a metal member so as to extend in the longitudinal direction and holds the pad member 101. As a material for the stay 102, it is desirable that only the heating belt 100 generates heat by the induction heating device 300 and therefore a non-magnetic material such as stainless steel which is not readily influenced by the induction heating device 300 is desirable.

Further, a material for the pad member 101 is a heat-resistant resin material such as PPS or LCP. In a pressing roller side of the pad member 101, a fixing pad 103 is held. The fixing pad 103 is formed of a high-rigidity material of metal such as stainless steel, or ceramics, or the like, and, e.g., has a thickness of, about 1 mm and a shape extending in the longitudinal direction.

Figure 4:
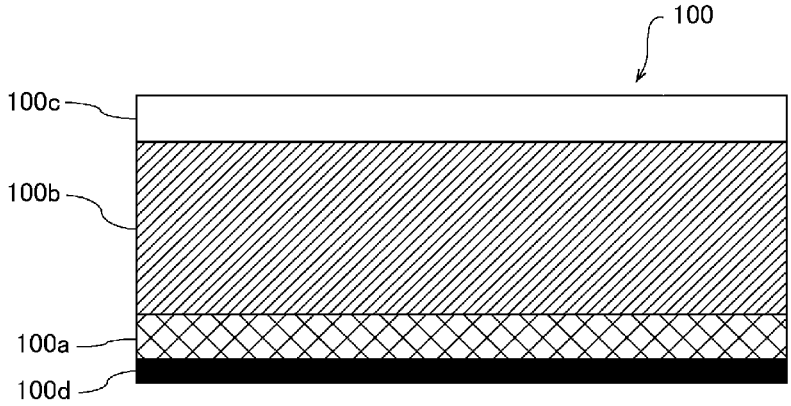
FIG. 4 is a schematic view showing a layer structure of a heating belt.

The heating belt 100 has a layer structure as shown in FIG. 4 and includes a base layer 100*a* of, e.g., about 20-40 mm in inner diameter and of, e.g., metal such as nickel. At an outer periphery of the base layer 100*a*, a heat-resistant rubber layer (e.g., a silicone rubber layer) is provided as an elastic layer 100*b*. The thickness of the rubber layer may preferably be set within a range of 100-800 μm. In this embodiment, the thickness of the rubber layer is 200 μm by taking into consideration that a warming-up time is shortened by decreasing heat capable of the heating belt 100 and that a suitable fixing image is obtained when a color image is fixed. Further, at an outer periphery of the elastic layer 100*b*, a fluorine-containing resin layer (e.g., PFA layer or PTFE layer) is provided as a surface parting layer 100*c*.

Inside the base layer 100*a*, in order to lower sliding friction between an inner peripheral surface of the heating belt 100 described later and a temperature sensor TH1, a sliding layer 100*d* having a high sliding property may also be provided in thickness of, e.g., 10-50 μm. In this embodiment, a 30 μm-thick polyimide layer is provided, and on its surface, heat-resistant grease as a lubricant is applied, so that a lubricating property at the inner surface of the heating belt 100 is maintained. Incidentally, as the material for the base layer 100*a* of the heating belt 100, it is possible to appropriately select iron alloy, copper, silver or the like.

Figure 5:
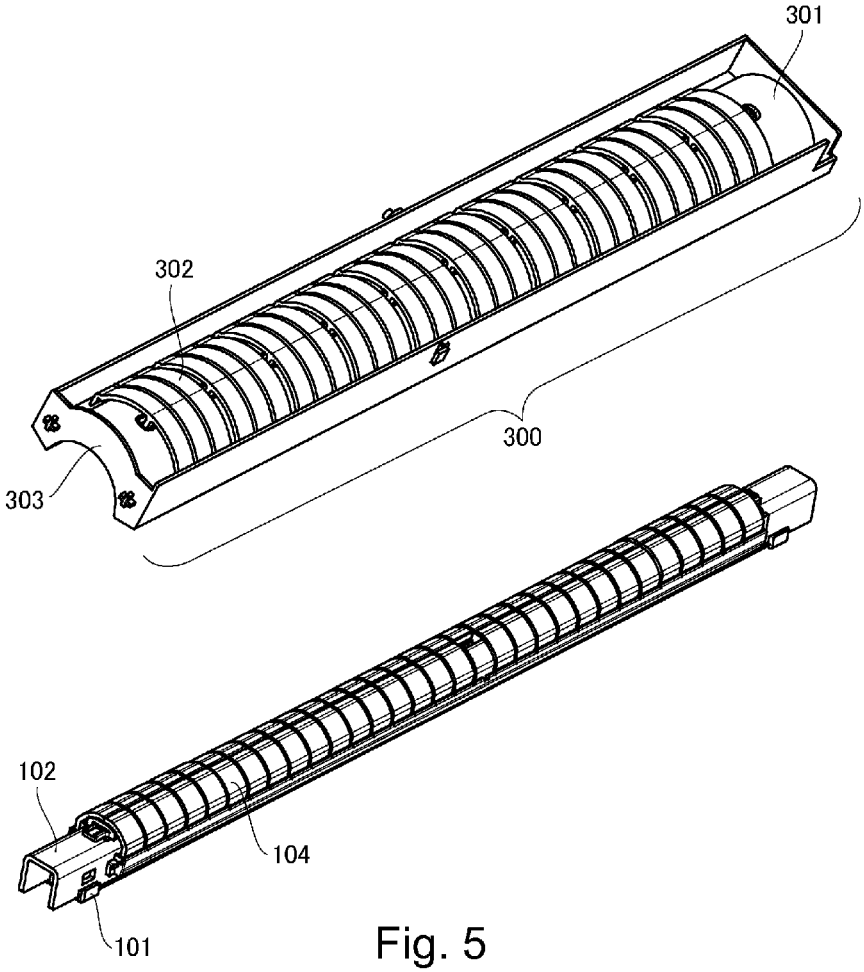
FIG. 5 is a perspective view showing an induction heating device (apparatus) and an inside core in an assembled state with a stay.

In an induction heating device 300 side of the stay 102, an inside core 104 as a magnetic core for guiding the magnetic flux generated by the induction heating device 300 to the heating belt 100 is provided in order to effectively perform the induction heating. That is, the inside core 104 is disposed between the heating belt 100 and the stay 102. In this embodiment, a plurality of inside cores 104 are disposed on the stay 102 so as to be substantially arranged along the longitudinal direction of the heating belt 100 as shown in FIG. 5. The stay 102 functions, as described later, also a holder for holding the plurality of inside cores 104. Further, the stay 102 is, in order to urge its end portions toward the pressing roller 200, formed in a free state so that the end portions are flexed in a direction in which the end portions are spaced from the pressing roller 200. Accordingly, by dividing the inside core 104 into a plurality of portions and disposing the inside core 104 at a plurality of positions, the plurality of inside cores 104 can be arranged along the flexible direction of the stay 102 in the free state.

Such an inside core 104 is formed of a high-permeability material such as ferrite or the like for shielding the magnetic flux in order to be used efficiently for heating the heating belt 100. For example, the inside core 104 is sintered ferrite formed by compressing and sintering powder principally formed of ferrite, and relative permeability thereof is about 1000-3000 under application of a high-frequency current of 100 kHz. A detailed description of an assembling constitution of the inside core 14 with the stay 102 will be made later.

The pressing roller 200 is, as shown in FIG. 2, e.g., 30 mm in order diameter and includes a (metal-made) core metal 200*a*, an elastic layer 200*b* formed, at a periphery of the core metal 200*a*, consisting of a layer of a rubber such as silicone rubber, and a parting layer 200*c* such as a fluorine-containing resin layer formed on the surface of the elastic layer 200*b*.

The stay 102 is, as shown in FIG. 3, supported at each of its end portions by a flange 105. The flange 105 is provided so as to be movable toward and away from a case 27*a* of the fixing device 27. Further, the flange 105 is provided with a regulating (limiting) member for regulating (limiting) longitudinal movement of the heating belt 100 and a circumferential shape of the heating belt 100. By the case 27*a* of the fixing device 27, a spring bearing member 106 is swingably supported at each of longitudinal end portions of the case 27*a*. Between a fixed portion of the case 27*a* and the spring bearing member 106, an urging spring 107 is provided, and by an urging force of the urging spring 107, the stay 102 is urged toward the pressing roller 200 via the spring bearing member 106 at each of the end portions of the stay 102.

As a result, the fixing pad 103 is urged toward the pressing roller 200 via the stay 102 and the pad member 101, and the heating belt 100 is press-contacted to the pressing roller 200 by the fixing pad 103, so that the nip having a predetermined width is formed. In this embodiment, under a load of about 40 kgf as nip pressure, the nip of about 8 mm in width with respect to a recording material conveyance direction is formed.

The heating belt 100 is rotated by rotational drive of the pressing roller 200 by a motor (driving means) M controlled by a control circuit portion 401. Thus, the heating belt 100 and the pressing roller 200 are rotationally driven at the substantially same peripheral speed as a conveyance speed of the recording material S, carrying thereon the unfixed toner image T, which is conveyed from the secondary transfer portion side shown in FIG. 1. Then, the nipped recording material S is conveyed while being heated and pressed at the nip N, so that the unfixed toner image T is fixed on the recording material S. In this embodiment, the heating belt 100 is rotated at a surface rotational speed of 300 mm/sec, so that a full-color image can be fixed on A4-sized sheet, at a rate of 65 sheets/min.

The induction heating device 300 includes, as shown in FIGS. 2 and 5, an exciting coil 301, an outside core 302 as the magnetic core, and a case 303. The exciting coil 301 is a magnetic flux generating means and uses Litz wire as an electric wire. The exciting coil 301 is prepared by being wound in an elongated (ships) bottom-like shape so as to oppose a part a peripheral surface and a side surface of the heating belt 100.

The outside core 302 is disposed to cover the exciting coil 301 so that a magnetic field generated by the exciting coil 301 is not substantially leaked to a portion other than a metal layer (electroconductive layer) of the heating belt 100. Such an outside core 302 is, similarly as the inside core 104, formed of the high-permeability material such as ferrite for shielding the magnetic flux. Further, the outside core 302 is, as shown in FIG. 5, divided into a plurality of portions and is disposed along the longitudinal direction of the fixing device 27. The case 303 supports the exciting coil 301 and the outside core 302 and is constituted by a, e.g., about 2 mm-thick layer of an electrically insulating resin material.

The thus-constituted induction heating device 300 is provided in an upper surface side of the outer peripheral surface of the heating belt 100 so as to oppose the heating belt 100 with a predetermined gap (spacing) between itself and the heating belt 100. In a rotation state of the heating belt 100, to the exciting coil 301 of the induction heating device 300, a high-frequency current of 20-60 kHz is applied from a power source device (exciting circuit) 400. Then, by the magnetic field generated by the exciting coil 301, the metal layer (electroconductive layer) of the heating belt 100 causes induction heat generation by the magnetic field generated by the exciting coil 301.

The temperature sensor (temperature detecting element) TH1 shown in FIG. 2 is, e.g., a thermistor and is provided in contact with the heating belt 100 at a position of a central inner surface portion of the heating belt 100 with respect to a widthwise direction of the heating belt 100. The temperature sensor TH1 detects a temperature of a heating belt portion constituting a sheet passing region in which the recording material passes through the nip N, and detected temperature information thereof is fed back to the control circuit portion 401. The control circuit portion 401 controls electric power to be inputted from the power source device 400 into the exciting coil 301 so that a detected temperature inputted from the temperature sensor TH1 can be kept at a predetermined target temperature (fixing temperature). That is, in the case where the detected temperature of the heating belt 100 is increased to the predetermined temperature, electric power supplied to the exciting coil 301 is interrupted. In this embodiment, on the basis of a detected value of the temperature by the temperature sensor TH1, a frequency of the high-frequency current is changed so that the heating belt temperature is kept at a constant temperature of 180° C. which is the target temperature of the heating belt 100, so that the electric power to be inputted into the exciting coil 301 is controlled to adjust the temperature.

A fixing process of the fixing device 27 in this embodiment will be described. As described above, to the exciting coil 301, the high-frequency current of 20-60 kHz is applied from the power source device 400 controlled by the control circuit portion 401, so that the heating belt 100 generates heat by induction heating. At this time, electric power to be inputted into the exciting coil 301 is controlled by changing the frequency of the high-frequency current on the basis of the detected value of the temperature sensor TH1 so that the temperature of the heating belt 100 is kept constant at the target temperature, thus adjusting the temperature.

In a state in which the heating belt 100 is increased in temperature to the predetermined target temperature (fixing temperature) and is temperature-controlled, the recording material S carrying thereon the unfixed toner image T is introduced into the nip N with a toner image-carrying surface thereof directed toward the outer peripheral surface of the heating belt 100. Then, at the nip N, the toner image-carrying surface of the recording material S is hermetically contacted to the outer peripheral surface of the heating belt 100, so that the recording material S is nipped and conveyed through the nip N together with the heating belt 100. As a result, heat is applied principally to the heating belt 100, and under application of the pressure at the nip N, the unfixed toner image T is fixed on the surface of the recording material S by heat and pressure. The recording material S passing through the nip N is self-separated from the outer peripheral surface of the heating belt 100 by deformation of the surface of the heating belt 100 at an exit portion of the nip N, and then is conveyed to the outside of the fixing device.

[Assembled Structure of Inside Core]

Figure 6:
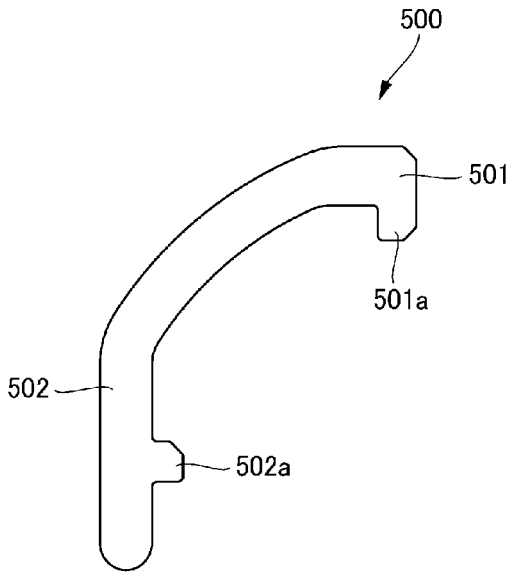
FIG. 6 is a front view showing a core element.
Figure 7:
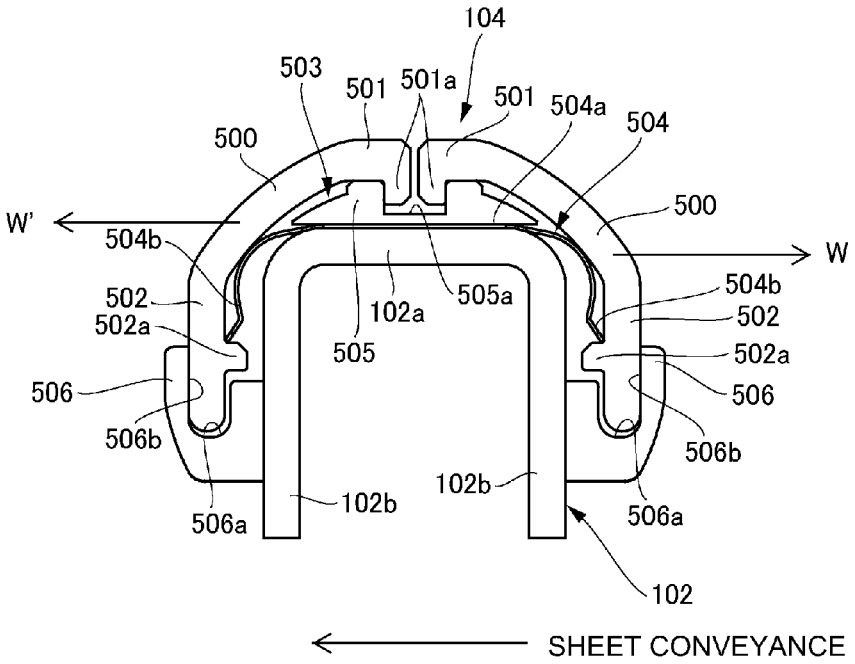
FIG. 7 is a sectional view showing a state in which the inside core is assembled with the stay.

Then, an assembled structure of the inside core 104 will be described with reference to FIGS. 6 to 14. The inside core 104 is, as shown in FIG. 6, constituted by a plurality of core elements 500 each formed in an almost ¼-arcuate (circular) shape in cross section. As shown in FIG. 7, a pair of (first and second) core elements 500 is provided in parallel substantially along a sheet conveyance direction (recording material conveyance direction). Further, the pair of core elements is, as shown in FIG. 5, is provided in a plurality of pairs (sets) thereof along the longitudinal direction of the heating belt 100. Each of the core element 500 includes a base portion 501 and an extended portion 502 extended from the base portion 501 so as to be curved along the heating belt 100. The base portion 501 is provided with a projection 501*a* projected toward the inside of the arcuate shape. Further, at a portion close to an end of the extended portion 502, the extended portion 502 is provided with a projected portion (engaging portion) 502*a* projected toward the inside of the arcuate shape (toward the stay in the assembled state).

The thus-constituted plurality of core elements 500 are, as shown in FIG. 7, assembled as the inside cores 104 with the stay 102 via an inside core holding member 503 functioning as a holder and an inside core holding spring 504 as an elastic member (urging member). Specifically, in an outside of the stay 102 (in the heating belt 100 side), the members are disposed (assembled) toward the heating belt 100 in the order of the inside core holding spring 504, the inside core holding member 503 and the inside core 104.

The stay 102 is constituted by a base plate portion 102*a* and a pair of side plate portions 102*b* bent from end portions of the base plate portion 102*a* in the same direction. The inside core 104 is disposed so as to cover the stay 102 having such a shape. Further, the inside core 104 has a substantially semicircular (arcuate) shape curved along the heating belt 100 by combining the core elements 500 each formed in the ¼-circular (arcuate) shape in cross section as described above.

The inside core holding member 503 is a member (holder) for holding the inside core 104, and includes a first member 505 provided outside the base plate portion 102*a* and a pair of second members 502 provided outside the pair of side plate portions 102*b*. In this embodiment, the first member 505 and the pair of second members 506 are provided as separate members, and each of these members is fixed to the stay 102. Incidentally, the first member 505 and the pair of second members 506 may also be integrally provided. The thus-constituted inside core holding member 503 is formed of a heat-resistant resin material.

At a surface of the first member 505 in a side opposite to the stay 102, a plurality of recessed portions (recesses or portions-to-engaged) 505*a* each engageable with the projection 501*a* of the base portion 501 for each core element 500 are formed. Further, the second members 506 are provided with a plurality recessed portions (recesses or portions-to-be-engaged) 506*b* where end portions of the respective extended portions 502 are capable of entering. Further, a contact portion (abutment portion) 506*b* where the extended portion 502 of each inside core 104 is urged by a spring 504 at an inside surface of the recessed portion 506*a* in a side toward the heating belt 100 is provided.

The inside core holding spring 504 is supported by the first member 505 of the inside core holding member 503 urges the inside core 104 toward a direction in which the inside core 104 is contacted to the second member 506 of the inside core holding member 503 (toward a direction crossing an inserting direction of the inside core into the recessed portion 506*a*). In this embodiment, the inside core holding spring 504 is a leaf spring formed by bending (folding) a metal plate-like elastic member. That is, the inside core holding spring 504 is formed of thin metal having a spring property and is formed in this embodiment with a stainless steel plate having a thickness of about 0.2 mm.

Figure 8:
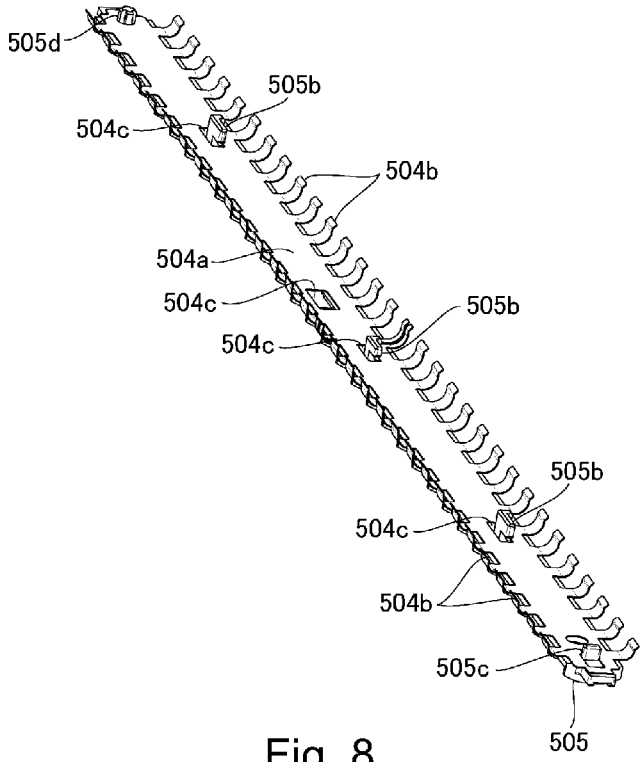
FIG. 8 is a perspective view showing a state, as seen from a spring side, in which an inside core holding spring is assembled with a first member of an inside core holding member.

Such an inside core holding spring 504 is constituted by a supporting plate portion 504*a* supported by the first member 505 and a plurality of urging plate portions (limiting portions) 504*b* bent in the same direction from each portions of the supporting plate portion 504*a*. Specifically, as shown in FIG. 8, the inside core holding spring 504 is provided with the plurality of urging plate portions 504*b* at the end portions of the supporting plate portion 504*a* along the longitudinal direction thereof, and is further provided with a plurality of holes 504*c* at a plurality of positions with respect to the longitudinal direction of the supporting plate portion 504*a*. The plurality of urging plate portions 504*b* are disposed so as to be located inside the inside cores 104 disposed in a plurality of positions with respect to the longitudinal direction in an assembled state shown in FIG. 7.

The supporting plate portion 504*a* is sandwiched between the first member 505 and the base plate portion 102*a* of the stay 102, and is fixed on the stay 102 by fixing the first member 505 toward the base plate portion 102*a*. Accordingly, the inside core holding spring 504 is fixed on the stay 102 by the inside core holding member 503.

The plurality of urging plate portions 504*b* are disposed between the inside core 104 and the stay 102, and urge the extended portions 502 constituting the respective core elements 500 toward the heating belt 100. As a result, the extended portions 502 of the core elements 500 are contacted to the contact portions 506*b* of the second member 506 of the inside core holding member 503. In other words, the contact portions 506*b* are contacted to surfaces, of the extended portions 502 urged by the urging plate portions 504*b*, opposite to surfaces in a side toward the stay 102. In this way, the extended portions 502 of the core elements 500 are urged by the plurality of urging plate portions 504*b*, so that the projection 501*a* of the base portion 501 of each core element 500 and an associated recessed portion 505*a* of the first member 505 are engaged with each other with respect to an urging direction by an associated one of the plurality of urging plate portions 504*b*. That is, each of the projections 501*a* of the inside core 104 is positioned at a side portion of the recessed portion 505*a* by being urged toward the outside with respect to the horizontal direction (arrow W or W' direction in FIG. 7).

Further, in this embodiment, the projected portions 502*a* formed at the extended portions 502 of the inside cores 104 and ends of the plurality of urging plate portions engage with each other, so that the inside cores 104 are prevented from being separated from the inside core holding spring 504. That is, the ends of the plurality of urging plate portions 504*b* contact base portions of the projected portions 502*a* in a base end side (in an upper side in FIG. 7), thus preventing the inside cores 104 from being disengaged upward in FIG. 7. Accordingly, in this embodiment, the projected portions 502*a* correspond to engaging portions for preventing separation between the inside cores 104 and the inside core holding spring 504.

Incidentally, such engaging portions are not limited to the illustrated projected portion but may also be recessed portions each recessed from the inside surfaces of the extended portions 502 toward an opposite side. In this case, the ends of the urging plate portions 504*b* enter the recessed portions, so that it is possible to prevent the separation between the inside cores 104 and the inside core holding spring 504. However, if contact pressure between the extended portions 502 and the urging plate portions 504*b* is large to ensure a frictional force capable of preventing the separation between the inside cores 104 and the inside core holding spring 504, the engaging portions as described above may also be omitted.

Further, the inside core holding spring 504 is, with respect to the exciting coil 301, disposed so as to be covered with the inside cores 104. That is, the inside core holding spring 504 is disposed so as to be sandwiched between the inside cores 104 and the stay 102, and when the inside core holding spring 504 is viewed from the exciting coil 301, the inside core holding spring 504 is shielded by the inside cores 104. That is, when the exciting coil 301 is projected onto the inside core holding spring 504, the inside core holding spring 504 is disposed so as to be hidden by the inside cores 104. For this reason, a relationship such that the inside core holding spring 504 is substantially magnetically shielded by the inside cores 104 is created, so that even when the thin metal layer as in the case of the inside core holding spring 504 is used, it is possible to reduce an amount of heat generation of the inside core holding spring 504 caused by the magnetic field generated by the exciting coil 301.

Figure 9:
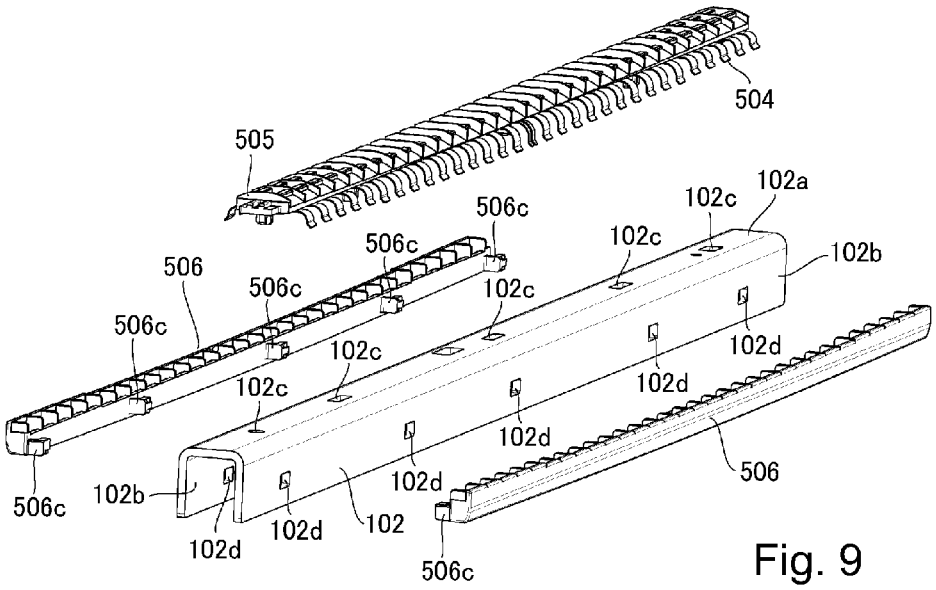
FIG. 9 is an exploded perspective view of the inside core holding member, the inside core holding spring and the stay.

Assembling of the inside core holding member 503 and the inside core holding spring 504, which are constituted as described above, with the stay 102 is performed in the following manner. That is, claw portions 505*b*, a rib 505*c* and a boss 505*d* which are provided on the first member 505 are engaged with or inserted into a plurality of holes 504*c* of the inside core holding spring 504, so that the first member 505 and the inside core holding spring 504 are integrated with each other. Thereafter, as shown in FIG. 9, the inside core holding spring 504 is sandwiched between the stay 102 and the first member 505, so that the first member 505 and the inside core holding spring 504 are assembled with the stay 102. At this time, the claw portions 505*b*, the rib 505*c* and the boss 505*d* provided on the first member 505 are engaged with or inserted into a plurality of holes 102*c* formed in the base plate portion 102*a* of the stay 102. As a result, the first member 505 and the inside core holding spring 504 are fixed to the stay 102.

Figure 10:
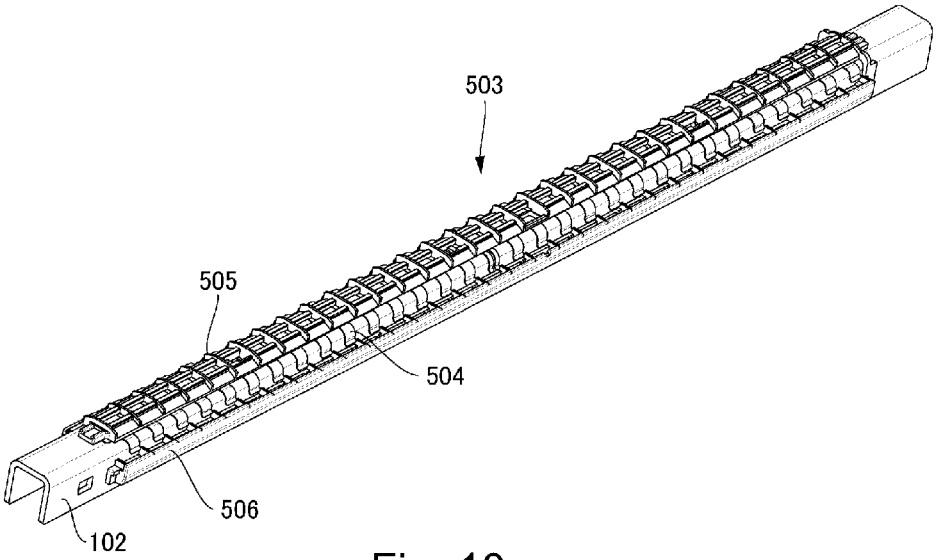
FIG. 10 is a perspective view showing a state in which the inside core holding member, the inside core holding spring and the stay are assembled.

Further, also with respect to the pair of second members 506 of the inside core holding member 503, a plurality of claw portions 506*c* provided on the second members 506 are engaged with a plurality of holes 102*d* provided in the side plate portion 102*b*, so that the second members 506 are assembled with the stay 102. As a result, as shown in FIG. 10, a state in which the inside core holding member 503 and the inside core holding spring 504 are assembled with the stay 102 is created.

Figure 11:
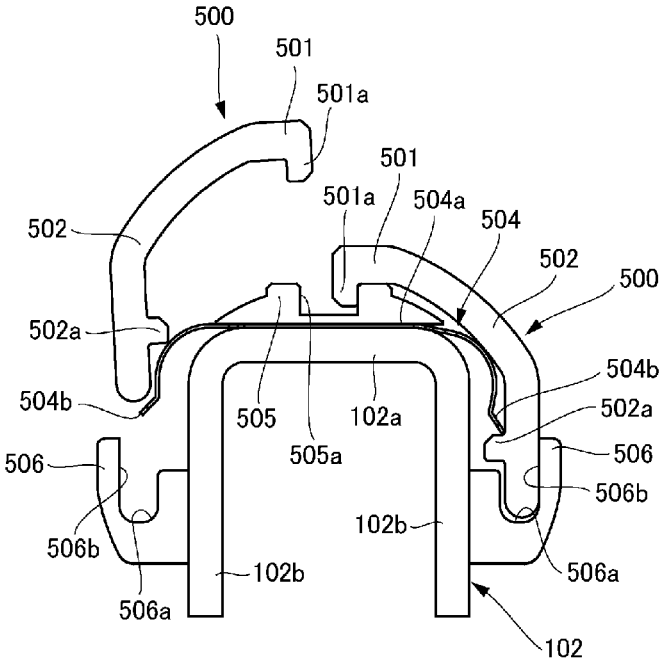
FIG. 11 is a sectional view showing a first stage in which the core element of the inside core is assembled with the inside core holding member.
Figure 12:
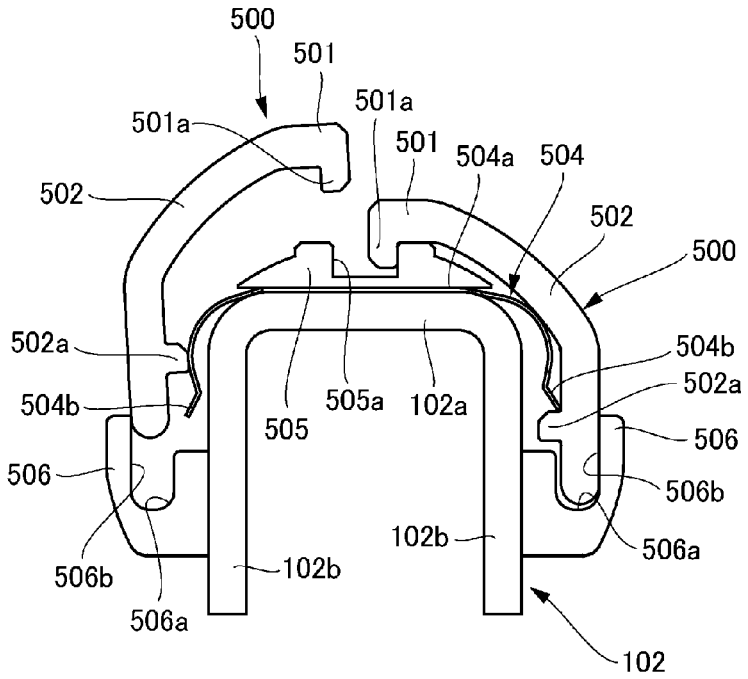
FIGS. 12, 13 and 14 are sectional view showing second, third and fourth stages, respectively, of the assembling.

Next, in this state, the inside core 104 is assembled. The order of steps of this assembling will be described with reference to FIGS. 11 to 14. Incidentally, in FIGS. 11 to 14, a state in which a single core element 500 of a plurality of core elements 500 of the inside core 104 is assembled is stepwisely shown, but other core elements 500 are similarly assembled. First, as shown in FIG. 11, the core element 500 is gradually engaged from an outside of the second member 506 of the inside core holding member 503. Then, as shown in FIG. 12, the urging plate portion 504*b* of the inside core holding spring 504 is urged by the projected portion 502*a* of the core element 500, so that the urging plate portion 504*b* is once retracted in the stay 102 side.

Figure 13:
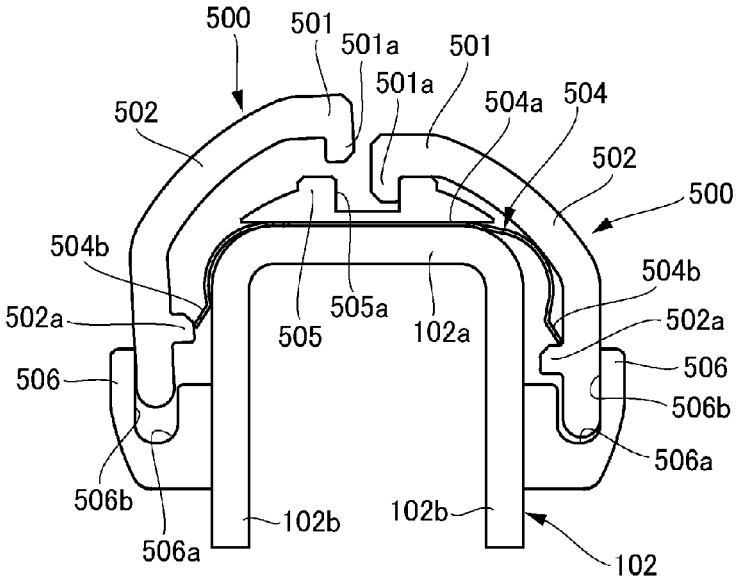
Figure 14:
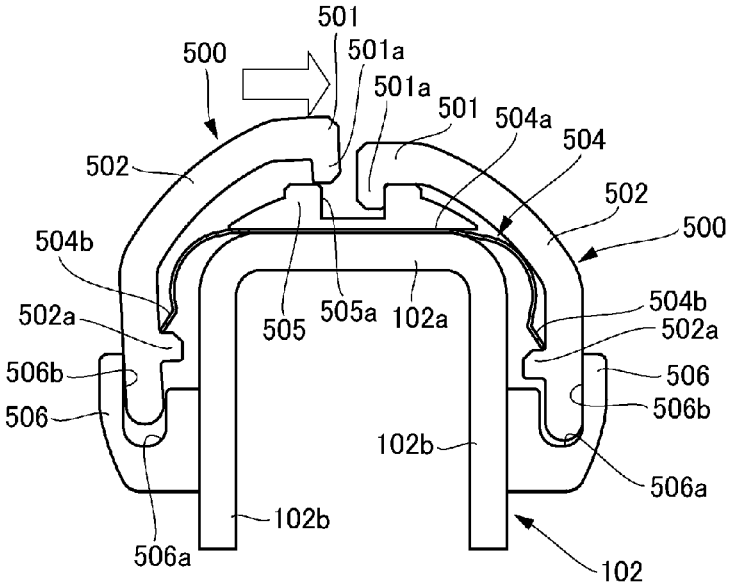

Further, as shown in FIG. 13, the core element 500 is gradually pressed into the recessed portion 506*a* of the second member 506 so that the extended portion 502 of the core element 500 is inserted into the recessed portion 506*a*. Then, as shown in FIG. 14, the projected portion 502*a* is pressed into a predetermined position, and when the urging plate portion 504*b* runs over the projected portion 502*a*, the urging plate portion 504*g* is returned to the outside and then enters a base portion of the projected portion 502*a* to be engaged with the projected portion 502*a*. Then, in this state, when the core element 500 is pushed in an arrow direction of FIG. 14, the projection 501*a* of the core element 500 enters the recessed portion 505*a* of the first member 505, so that as shown in FIG. 7, the core element 500 is assembled with the inside core holding member 503 fixed to the stay 102.

Further, in this state, the urging plate portion 504*b* of the inside core holding spring 504 urges the extended portion 502 of the core element 500, so that the extended portion 502 is contacted to the contact portion 506*b* of the second member 506.

In this embodiment, as described above, each of the core elements 500 is urged by the inside core holding spring 504 in the direction in which each core element 500 is contacted to the second member 506 of the inside core holding member 503. For this reason, the inside core 104 can be fixed to the inside core holding member 503 without using an adhesive. Further, at this time, the projection 501*a* of the core element 500 enters the recessed portion 505*a* of the first member 505, and then the projection 501*a* and the recessed portion 505*a* are engaged with each other, so that the core element 500 can be fixed on the inside core holding member 503 in a state in which an attitude of the core element 500 is stabilized.

Further, the urging plate portion 504*b* of the inside core holding spring 504 enters the base portion of the projected portion 502*a* of the core element 500, so that the inside core holding spring 504 is engaged with the core element 500. For this reason, the core element 500 is prevented from being separated from the inside core holding member 503 and the inside core holding spring 504 which are fixed to the stay 102.

Thus, in this embodiment, it is possible to provide the fixing device which improves an assembling property of the inside core 104 and has high positional accuracy of a mounting position of the inside core 104, with an inexpensive and simple constitution.

Incidentally, in the above description, an example in which the inside core was constituted by the core element having the almost ¼ circular shape was explained. However, the shape of the inside core may also be a semicircular shape such that the inside core covers ½ of a circumference of the heating belt or may also be a flat plate-like shape if the inside core is disposed so as to surround a periphery of the stay. In this case, the inside core may also be urged, e.g., downward in FIG. 7.

Further, so long as an assembling time and an assembling procedure during manufacturing are not considerably worsen, use of the adhesive is not intended to be prohibited. For example, a constitution in which the adhesive is applied to a part of the contact portion 506*b* of the inside core holding member 503 in advance and thereafter the end portion 502 of the inside core 104 is inserted may also be employed.

Second Embodiment

Second Embodiment of the present invention will be described with reference to FIG. 15. In First Embodiment described above, the present invention is applied to the portion where the inside core is assembled, but in this embodiment, the present invention is applied to a portion where an outside core is assembled.

Figure 15:
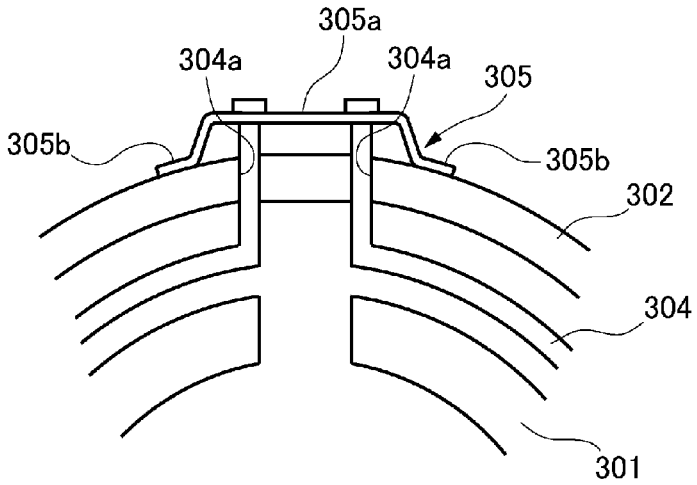
FIG. 15 is a schematic view for illustrating an assembling state of an outside core of a fixing device in Second Embodiment.

As shown in FIG. 15, the outside core 302 is held by an outside core holding member 304 formed of a heat-resistant resin material. The outside core holding member 304 is provided between the outside core 302 and the exciting coil 301 and is fixed to the case 303 (FIG. 2). Further, in an opposite side to the exciting coil 301 of the outside core 302, an outside core holding spring 305 as the urging means is provided. The outside core holding spring 305 is a spring formed by bending a plate-like elastic material, and is constituted by a supporting plate portion 305*a* and urging plate portions 305*b*, as an urging portion, bent from end portions of the supporting plate portion 504*a* in the same direction.

The outside core holding member 304 is provided with a penetrating portion 304*a* which penetrates the outside core 302. Further, an end portion of the penetrating portion 304*a* supports the supporting plate portion 305*a* of the outside core holding spring 305. In this embodiment, the end portion of the penetrating portion 304*a* is penetrated through the supporting plate portion 305*a* and then the penetrated portion is crushed, so that the supporting plate portion 305*a* is supported by the crushed end of the penetrating portion 304*a*. In this state, the urging plate portion 305*b* of the outside core holding spring 305 urges the outside core 302 toward a direction in which the outside core 302 is contacted to the outside core holding member 304. As a result, the outside core 302 is fixed to the outside core holding member 304.

Incidentally, in this embodiment, the outside core holding spring 305 is disposed so as to be covered with the outside core 302 with respect to the exciting coil 301. Further, an amount of heat generation of the outside core holding spring 305 caused by the magnetic field generated by the exciting coil 301 is decreased. Other constitutions and actions are similar to those in First Embodiment.

Other Embodiments

In the above-described embodiments, an example in which the thin metal plate is used as the elastic member (urging member) for urging the inside core or the outside core is described, but as the urging member (means), a heat-resistant film or heat-resistant resin material, which has a heat-resistant property of 100° C. or more may also be used. Here, the heat-resistant property of 100° C. or more refers to a property such that the film or the resin material is hard to be deformed or melted. In this case, if the film or the resin material is formed of a material in a thickness such that the film or the resin material does not generate heat by induction heating, the film or the resin material is not required to be disposed inside the inside core or outside the outside core, but may also be disposed in the heating belt side of the inside core or the outside core and may also be mounted so as to cover the inside core or the outside core. Further, as the urging member (means), other than the spring formed by bending the plate-like elastic member, the elastic member such as a coil spring or a rubber may also be used.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 195668/2012 filed Sep. 6, 2012, which is hereby incorporated by reference.

What is claimed is:

1. An image heating apparatus comprising:

a rotatable heating member configured to heat a toner image on a sheet;

an exciting coil configured to cause said rotatable heating member to generate heat by electromagnetic induction heating;

a magnetic core configured to guide magnetic flux, generated by said exciting coil, to said rotatable heating member, wherein said magnetic core includes a first engaging portion in the neighborhood of an end thereof and a second engaging portion in the neighborhood of another end thereof;

a holder holding said magnetic core and including a first recess into which the first engaging portion is inserted and a second recess into which the second engaging portion is inserted; and an elastic member fixed on said holder, wherein said elastic member urges the first engaging portion, inserted into the first recess, in a direction perpendicular to an inserting direction so that a position of the second engaging portion is determined by the second recess.

2. An image heating apparatus according to claim 1, wherein said elastic member includes a limiting portion configured to limit movement of the first engaging portion in a direction opposite to the inserting direction of the first engaging portion into the first recess.

3. An image heating apparatus according to claim 2, wherein said elastic member is a leaf spring bent at a longitudinal end portion thereof, and wherein the longitudinal end portion functions as the limiting portion.

4. An image heating apparatus according to claim 3, wherein the first engaging portion is a projection engageable with the longitudinal end portion of the leaf spring.

5. An image heating apparatus according to claim 1, wherein said elastic member is magnetically shielded between itself and said exciting coil by said magnetic core.

6. An image heating apparatus according to claim 1, wherein said magnetic core is provided inside said rotatable heating member.

7. An image heating apparatus according to claim 1, wherein said magnetic core is provided in a plurality of positions so as to be arranged along a longitudinal direction of said rotatable heating member, and wherein said elastic member is provided in a plurality of positions correspondingly to said magnetic cores.

8. An image heating apparatus comprising:

a rotatable heating member configured to heat a toner image on a sheet;

an exciting coil configured to cause said rotatable heating member to generate heat by electromagnetic induction heating;

first and second magnetic cores arranged along a sheet conveyance direction and each configured to guide magnetic flux, generated by said exciting coil, to said rotatable heating member, wherein said first magnetic core includes a first engaging portion in the neighborhood of an end thereof and a second engaging portion in the neighborhood of another end thereof, and wherein said second magnetic core includes a third engaging portion in the neighborhood an end thereof and a fourth engaging portion in the neighborhood of another end thereof;

a holder holding said first and second magnetic cores and including a first recess into which the first engaging portion is inserted, a second recess into which the second engaging portion is inserted, a third recess into which the third engaging portion is inserted; and a fourth recess into which the fourth engaging portion is inserted; and an elastic member fixed on said holder, wherein said elastic member urges the first engaging portion inserted into the first recess and the third engaging portion inserted into the third recess in a direction perpendicular to an inserting direction so that positions of the second engaging portion and the fourth engaging portion are determined by the second recess and the fourth recess, respectively.

9. An image heating apparatus according to claim 8, wherein said elastic member includes a first limiting portion configured to limit movement of the first engaging portion in a direction opposite to the inserting direction of the first engaging portion into the first recess and includes a second limiting portion configured to limit movement of the third engaging portion in a direction opposite to the inserting direction of the third engaging portion into the third recess.

10. An image heating apparatus according to claim 9, wherein said elastic member is a leaf spring bent at a longitudinal end portion thereof, and wherein the longitudinal end portion functions as the first limiting portion, and another longitudinal end portion of the leaf spring functions as the second limiting portion.

11. An image heating apparatus according to claim 10, wherein the first engaging portion is a projection engageable with the longitudinal end portion of the leaf spring, and the third engaging portion is a projection engageable with said another longitudinal end portion of the leaf spring.

12. An image heating apparatus according to claim 8, wherein said elastic member is magnetically shielded between itself and said exciting coil by said first and second magnetic cores.

13. An image heating apparatus according to claim 8, wherein said first and second magnetic cores are provided inside said rotatable heating member.

14. An image heating apparatus according to claim 8, wherein each of said first and second magnetic cores is provided in a plurality of positions so as to be arranged along a longitudinal direction of said rotatable heating member, and wherein said elastic member is provided in a plurality of positions corresponding to the plurality of positions of said first and second magnetic cores.

15. An image heating apparatus comprising:

a rotatable heating member configured to heat a toner image on a sheet;

an exciting coil configured to cause said rotatable heating member to generate heat by electromagnetic induction heating;

a magnetic core configured to guide magnetic flux, generated by said exciting coil, to said rotatable heating member, wherein said magnetic core includes an engaging portion in the neighborhood of an end portion thereof;

a holder holding said magnetic core and including a recess into which the end portion of said magnetic core is inserted; and an elastic member fixed on said holder, wherein said elastic member includes a limiting portion configured to limit movement of the engaging portion in a direction opposite to the inserting direction of the engaging portion into the recess.

16. An image heating apparatus according to claim 15, wherein said elastic member is a leaf spring which has a U-like shape in cross section and which is bent at a longitudinal end portion thereof toward a direction crossing the inserting direction, and wherein the longitudinal end portion functions as the limiting portion.

17. An image heating apparatus according to claim 16, wherein the first engaging portion is a projection engageable with the longitudinal end portion of the leaf spring.

18. An image heating apparatus according to claim 15, wherein said elastic member is magnetically shielded between itself and said exciting coil by said magnetic core.

19. An image heating apparatus according to claim 15, wherein said magnetic core is provided inside said rotatable heating member.

20. An image heating apparatus according to claim 15, wherein said magnetic core is provided in a plurality of positions so as to be arranged along a longitudinal direction of said rotatable heating member, and wherein said elastic member is provided in a plurality of positions correspondingly to said magnetic core.

21. An image heating apparatus comprising:

a rotatable heating member configured to heat a toner image on a sheet;

an exciting coil configured to cause said rotatable heating member to generate heat by electromagnetic induction heating;

first and second magnetic cores arranged along a sheet conveyance direction and each configured to guide magnetic flux, generated by said exciting coil, to said rotatable heating member, wherein said first first magnetic core includes a first engaging portion in the neighborhood of an end thereof, and wherein said second magnetic core includes a second engaging portion in the neighborhood of an end thereof;

a holder holding said first and second magnetic cores and including a first recess into which the first engaging portion is inserted, and a second recess into which the second engaging portion is inserted; and an elastic member fixed on said holder, wherein said elastic member includes a first limiting portion configured to limit movement of the first engaging portion in a direction opposite to an inserting direction of the first engaging portion into the first recess and includes a second limiting portion configured to limit movement of the second engaging portion in a direction opposite to the inserting direction of the second engaging portion into the second recess.

22. An image heating apparatus according to claim 21, wherein said elastic member is a leaf spring which has a U-like shape in cross section and which is bent at longitudinal end portions thereof toward a direction crossing the inserting direction, and wherein the longitudinal end portions function as the first limiting portion and the second limiting portion.

23. An image heating apparatus according to claim 22, wherein the first engaging portion is a projection engageable with the longitudinal end portion of the leaf spring, and the second engaging portion is a projection engageable with said another longitudinal end portion of the leaf spring.

24. An image heating apparatus according to claim 21, wherein said elastic member is magnetically shielded between itself and said exciting coil by said first and second magnetic cores.

25. An image heating apparatus according to claim 21, wherein said first and second magnetic cores are provided inside said rotatable heating member.

26. An image heating apparatus according to claim 21, wherein each of said first and second magnetic cores is provided in a plurality of positions so as to be arranged along a longitudinal direction of said rotatable heating member, and wherein said elastic member is provided in a plurality of positions corresponding to the plurality of positions of said first and second magnetic cores.

* * * * *